US010598331B1

(12) United States Patent
Bhakta et al.

(10) Patent No.: US 10,598,331 B1
(45) Date of Patent: Mar. 24, 2020

(54) PROJECTION DEVICE WITH FIELD SPLITTING ELEMENT

(71) Applicant: Texas Instruments Incorporated, Dallas, TX (US)

(72) Inventors: Vikrant R. Bhakta, Sunnyvale, CA (US); Gavin Perrella, Dallas, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 16/204,640

(22) Filed: Nov. 29, 2018

(51) Int. Cl.

| | |
|---|---|
| ***F21V 5/00*** | (2018.01) |
| ***F21S 41/675*** | (2018.01) |
| ***F21S 41/27*** | (2018.01) |
| ***F21S 41/36*** | (2018.01) |
| ***F21S 41/20*** | (2018.01) |
| *F21W 107/10* | (2018.01) |

(52) U.S. Cl.
CPC ..... *F21S 41/675* (2018.01); *F21S 41/27* (2018.01); *F21S 41/285* (2018.01); *F21S 41/36* (2018.01); *F21W 2107/10* (2018.01)

(58) Field of Classification Search
CPC ..... F21S 41/25–295; F21S 41/36; F21S 41/60–698; F21W 2107/10
USPC ..... 362/509, 520–522, 538–539
See application file for complete search history.

(56) References Cited

U.S. PATENT DOCUMENTS

| | | | |
|---|---|---|---|
| 9,291,819 | B2 | 3/2016 | Ferri |
| 9,658,447 | B2 | 5/2017 | Bhakta |
| 2015/0377442 | A1 | 12/2015 | Bhakta |

*Primary Examiner* — Jason M Han
(74) *Attorney, Agent, or Firm* — Michael A. Davis, Jr.; Charles A. Brill; Frank D. Cimino

(57) ABSTRACT

Described examples include a projection device having a light source. The projection device also has a spatial light modulator arranged to receive light from the light source and provide modulated light. The projection device also has projection optics arranged to receive and project the modulated light. The projection device also has a field splitting element between the spatial light modulator and the projection optics, a first portion of the field splitting element being structured to pass at least a first portion of the modulated light to the projection optics for projection at a first focal length, and a second portion of the field splitting element being structured to pass at least a second portion of the modulated light to the projection optics for projection at a second focal length.

20 Claims, 3 Drawing Sheets

PROJECTION DEVICE WITH FIELD SPLITTING ELEMENT

TECHNICAL FIELD

This relates generally to projection devices, and more particularly to modulated projection devices.

BACKGROUND

Modulated projector lights provide great versatility and functionality for automobiles and other applications. For example, imaging systems, such as Light Detection and Ranging (LIDAR) can determine the position of an oncoming vehicle. Rather than shift from high-beam to low-beam to avoid blinding the driver of the oncoming vehicle, the output of the headlights can be modulated to only shine on the lower portion of the oncoming vehicle and avoid blinding the other driver. In addition, images such as warnings can be projected onto the pavement ahead of the vehicle. An example of such a system is shown in U.S. Pat. No. 9,658,474, which is co-owned with this application and is incorporated herein by reference. However, to provide high light throughput, modulated projector systems often use a very wide aperture (f<3). The use of a large aperture causes a narrow depth of focus. Thus, if the projection lenses have a close focus, distant projected images will be out of focus and vice versa.

SUMMARY

In accordance with an example, a projection device has a light source. The projection device also has a spatial light modulator arranged to receive light from the light source and provide modulated light. The projection device also has projection optics arranged to receive and project the modulated light. The projection device also has a field splitting element between the spatial light modulator and the projection optics, a first portion of the field splitting element being structured to pass at least a first portion of the modulated light to the projection optics for projection at a first focal length, and a second portion of the field splitting element being structured to pass at least a second portion of the modulated light to the projection optics for projection at a second focal length.

DETAILED DESCRIPTION

Corresponding numerals and symbols in the different figures generally refer to corresponding parts unless otherwise indicated. The figures are not necessarily drawn to scale.

The term "coupled" may include connections made with intervening elements, and additional elements and various connections may exist between any elements that are "coupled."

In the arrangements, the problem of differing target focal distances is solved by using a field splitting element to provide a projection device with differing focal lengths.

Figure 1:
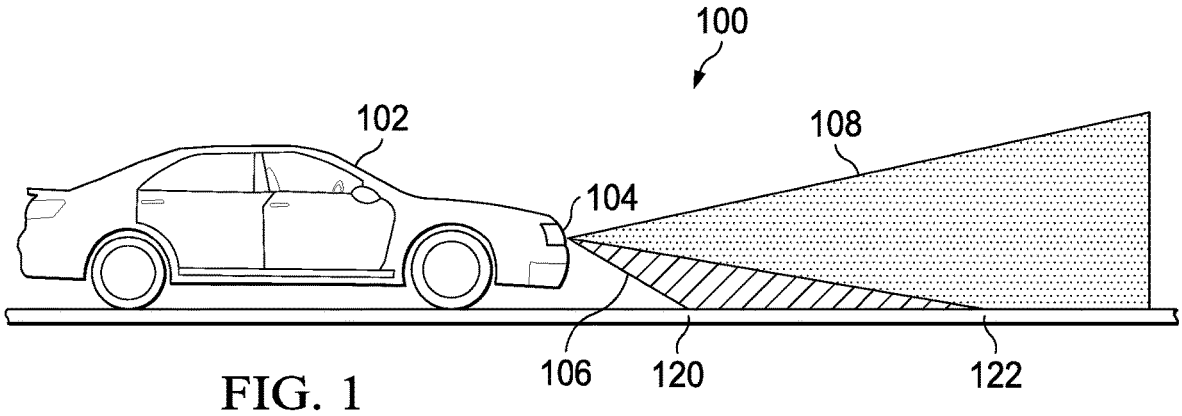
FIG. 1 is a diagram showing an automobile with modulated headlights.

FIG. 1 shows a scene 100 with an automobile 102 with modulated headlights 104. Modulated headlights 104 project modulated light to two zones: near zone 106 and far zone 108. Among other functions, near zone 106 projects informational images onto the pavement in front of automobile 102. Among other functions, far zone 108 provides glare-free lighting. In glare-free lighting, the projected light is modulated so that the light does not shine on places with a high probability of blinding a viewer. This allows for the use full intensity light while avoiding blinding drivers in other vehicles. However, the focus of the near zone is less than about 10 meters, but the focus of the far zone is essentially infinite, for example. As a practical example, the focus of the far zone may be set at 25 to 50 meters. Modulated headlights 104 use a wide aperture (e.g., f<3) to provide high light output. However, a large aperture provides a small depth of focus.

Figure 2:
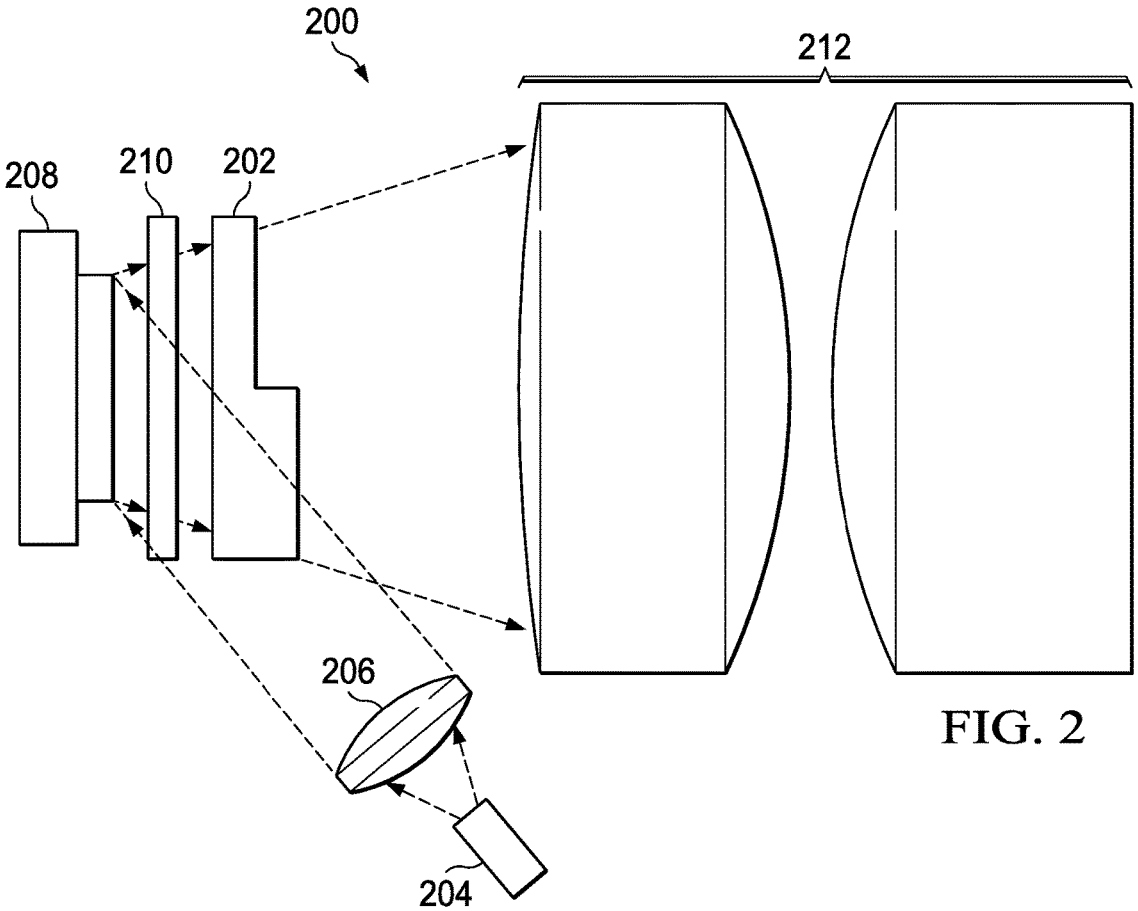
FIG. 2 is a diagram showing an example projection system using a field splitting element (FSE).

FIG. 2 shows an example projection system 200 using a field splitting element (FSE) 202. Projection system 200 may be used as headlight projection device for an automobile headlight such as modulated headlights 104 (FIG. 1), among other applications. In projection system 200, light source 204 provides high intensity light. Light source 204 may be, for example, a light emitting diode (LED), laser diode or a high intensity discharge lamp. Illumination optics 206 direct the light onto spatial light modulator 208. Illumination optics 206 may include multiple components, such as lenses, light tunnels and other mechanisms to provide homogenous light to spatial light modulator 208. In an example, light from light source 204 may pass at least partially through FSE 202 on its path to spatial light modulator 208.

Spatial light modulator 208 selectively reflects the light through window 210 and FSE 202. Window 210 is part of the packaging of spatial light modulator 208. For example, spatial light modulator 208 may be a digital micromirror device (DMD), a liquid crystal display (LCD) or liquid crystal on silicon (LCOS). Window 210 protects the mirrors of spatial light modulator 208 while providing optical transparency. In an alternative example, FSE 202 and window 210 may be combined into one element. Each pixel of spatial light modulator 208 selectively reflects light from light source 204 toward or away from projection optics 212 to provide the desired projected image. After passing through FSE 202, the light is projected by projection optics 212. Projection optics 212 has a fixed focal length or a variable focal length that may be adjusted over a relatively long time, and thus is essentially fixed. As explained further hereinbelow, FSE 202, modifies the focal point of an image modulated by spatial light modulator 208 for different portions of the image projected by projection optics 212 so that one portion of the image focuses at a greater distance that another portion of the image.

Figure 3:
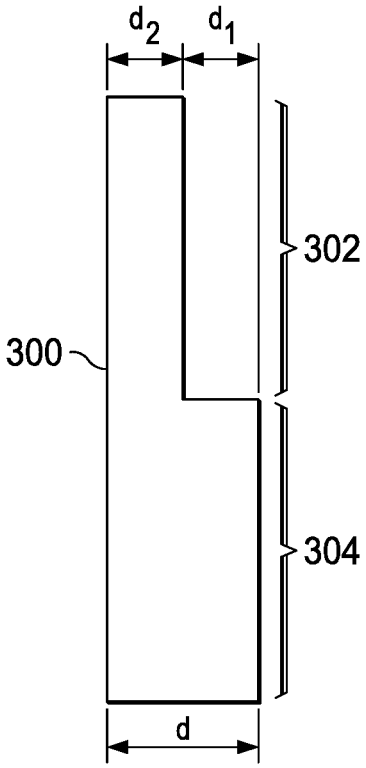
FIG. 3 is a diagram showing an FSE like the FSE of FIG. 2.

FIG. 3 shows an FSE 300 like FSE 202 (FIG. 2). In this example, FSE 300 comprises an optically transparent material with a refractive index n that is greater than one. FSE 300 has a first portion 302 with a thickness of $d_2$ and a second portion 304 with a thickness of d. The difference between thicknesses d and $d_2$ is thickness $d_1$. The FSEs discussed herein may include a coating to block infrared and ultraviolet radiation to protect the spatial light modulator 208 (FIG. 2). As further explained hereinbelow, the differing thicknesses of FSE 300 allow for differing image focal lengths for different portions of the image modulated by a spatial light modulator such as spatial light modulator 208.

Figure 4:
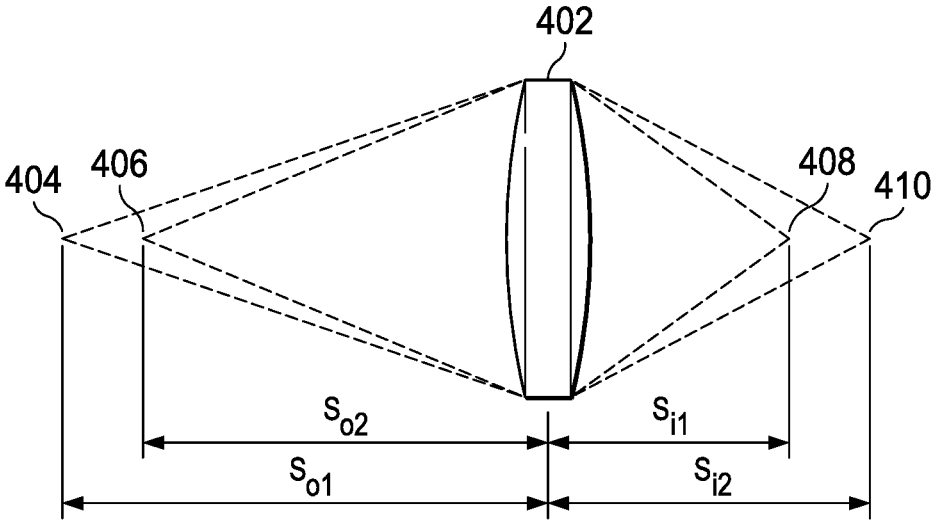
FIG. 4 is a diagram showing differing image focal points for differing object points relative to a lens with a fixed focal length.

FIG. 4 is a diagram showing differing image focal lengths for differing object points relative to a lens 402 with a fixed focal length. Object 404 has a distance to the center of lens 402 of $S_{o1}$. Object 406 has a distance to the center of lens 402 of $S_{o2}$. The distance of image 408, which is an image of object 404, is $S_{i1}$. The distance of image 410, which is an image of object 406, is $S_{i2}$. The relationship between the object distance, the image distance and the lens focal length is given by Equation (1).

$$\frac{1}{f} = \frac{1}{S_o} + \frac{1}{S_i} \tag{1}$$

Where f is the focal length of the lens, $S_o$ is the distance of the object to the lens and $S_i$ is the focal point for the image of the object. As shown in Equation (1), a larger object distance results in a shorter image distance and vice versa, assuming a fixed focal length for the lens. Using Equation (1), the relationship of object 404 and image 408 is given by Equation (2);

$$\frac{1}{f} = \frac{1}{S_{o1}} + \frac{1}{S_{i1}} \tag{2}$$

and the relationship of object 406 and image 410 is given by Equation (3).

$$\frac{1}{f} = \frac{1}{S_{o2}} + \frac{1}{S_{i2}} \tag{3}$$

Solving Equation (2) for $S_{i1}$ yields Equation (4).

$$S_{i1} = \frac{fS_{o1}}{S_{o1} - f} \tag{4}$$

Solving Equation (3) for $S_{i2}$ yields Equation (5).

$$S_{i2} = \frac{fS_{o2}}{S_{o2} - f} \tag{5}$$

Using Equations (4) and (5) to determine the difference between $S_{i1}$ and $S_{i2}$ yields Equation (6).

$$\Delta S_i = S_{i1} - S_{i2} = \frac{fS_{o1}S_{o2} - f^2S_{o1} - fS_{o2}S_{o1} + f^2S_{o2}}{S_{o1}S_{o2} - fS_{o1} - fS_{o2} + f^2} = \frac{f^2S_{o2} - f^2S_{o1}}{S_{o1}S_{o2} - fS_{o1} - fS_{o2} + f^2} \tag{6}$$

The optical path length through a material with a refractive index greater than one is the length of travel through the material multiplied by the refractive index of the material. As shown in FIG. 4, a longer object length provides a shorter image focal point. Referring to FIG. 3, the difference in the optical path length through second portion 304 ($OPL_1$) and the optical path length through first portion 302 ($OPL_2$) (i.e., the difference in the image focal point $\Delta S_i$) is determined by Equation (7).

$$\Delta S_i = OPL_1 - OPL_2 = nd - (nd_2 + d - d_2) \tag{7}$$

Where n is the refractive index of the material of FSE 300. Simplifying Equation (7) yields Equation (8).

$$\Delta S_i = d(n-1) + d_2(1-n) \tag{8}$$

Equating Equation (8) and Equation (6) allows for the determination of the parameters d, $d_2$ and n of the FSE to achieve the desired image focal points for images passing through the first portion 302 (FIG. 3) and second portion 304 (FIG. 3). This allows for differing image focal points for different portions of the image projected by projection system 200 (FIG. 2). For example, referring to FIG. 1, this allows for different image focal points for near zone 106 and far zone 108, allowing both zones to have good focus despite a narrow depth of focus provided by projection optics 212 (FIG. 2).

Figure 5:
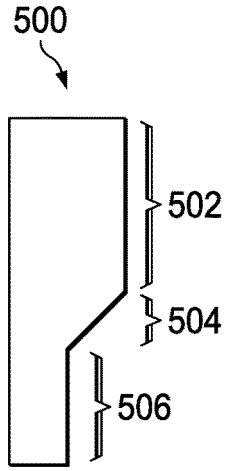
FIG. 5 is a diagram showing another example FSE.

FIG. 5 shows another example FSE 500. In examples, FSE 500 replaces FSE 202 (FIG. 2). FSE 500 includes first portion 502, transition portion 504 and second portion 506. As with the other described FSEs, the position of the first portion 502 and the second portion 506 within a projection system like system 200 (FIG. 2) is selected based on whether the projection optics 212 (FIG. 2) inverts the image or not. For example, first portion 502 is positioned to project the lower portion of the beam (e.g. near zone 106 (FIG. 1)) and second portion 506 is positioned to project the upper portion of the beam (e.g. far zone 108 (FIG. 1)). First portion 502 and second portion 506 have a constant thickness, and thus function in a comparable manner to the first portion 302 and second portion 304 of FSE 300 (FIG. 3). Transition portion 504 has a varying thickness, and thus a varying focal point along its length. This avoids an abrupt change in the image focal position and provides for better focus of images in the transition from a near focal region (first portion 502) to a far focal region (second portion 506).

Figure 6:
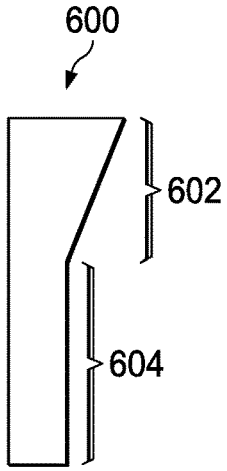
FIG. 6 is a diagram showing another example FSE.

FIG. 6 shows another example FSE 600. FSE 600 includes a first portion 602 and a second portion 604. In examples, FSE 600 replaces FSE 202 (FIG. 2). Rather than first portion 602 being a uniform thickness as with first portion 302 of FSE 300 (FIG. 3) or first portion 502 of FSE 500 (FIG. 5), first portion 602 has a variable thickness that varies linearly from a thickest part at the end of first portion 602 farthest from second portion 604 to a thickness equal to the second portion 604 adjacent to the second portion 604. Thus, the focal point of the image projected through first portion 602 varies linearly from relatively close to relatively far. The purpose of this configuration is shown by FIG. 1.

The image projected through first portion 602 is projected in near zone 106 (FIG. 1) in this example. The distance from headlights 104 to point 120 (FIG. 1) is relatively small; for example, approximately 2 meters. The distance from headlights 104 to point 122 (FIG. 1) is relatively long; for example, 10 meters. The focus issues caused by a projection onto a plane that is not perpendicular to the projector is known as the Scheimpflug principle. A projection system using a field splitting element like FSE 600 corrects for the Scheimpflug focus distortions and allows for a focused image at all points from point 120 to point 122 (FIG. 1).

Figure 7:
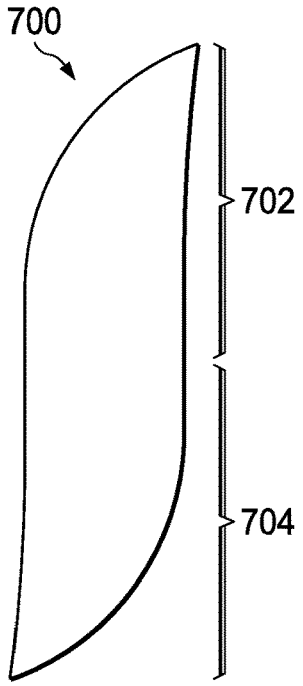
FIG. 7 is a diagram showing another example FSE.

FIG. 7 shows another example FSE 700. In examples, FSE 700 replaces FSE 202 (FIG. 2). FSE 700 includes a first portion 702 and a second portion 704 having different curvatures in addition to varying thicknesses. First portion 702 has a tilted, convex profile relative to the incoming light from spatial light modulator 208 (FIG. 2). Second portion 704 has a tilted, concaved profile relative to the incoming light from spatial light modulator 208 (FIG. 2). Because of these profiles, FSE 700 functions as a lens to tilt the direction of the images passing through FSE 700 and to modify the focal properties of the light paths along with projection optics 212 (FIG. 2). Thus, FSE 700 allows for very precise tailoring of the focal points of the image passing through FSE 700.

Figure 8:
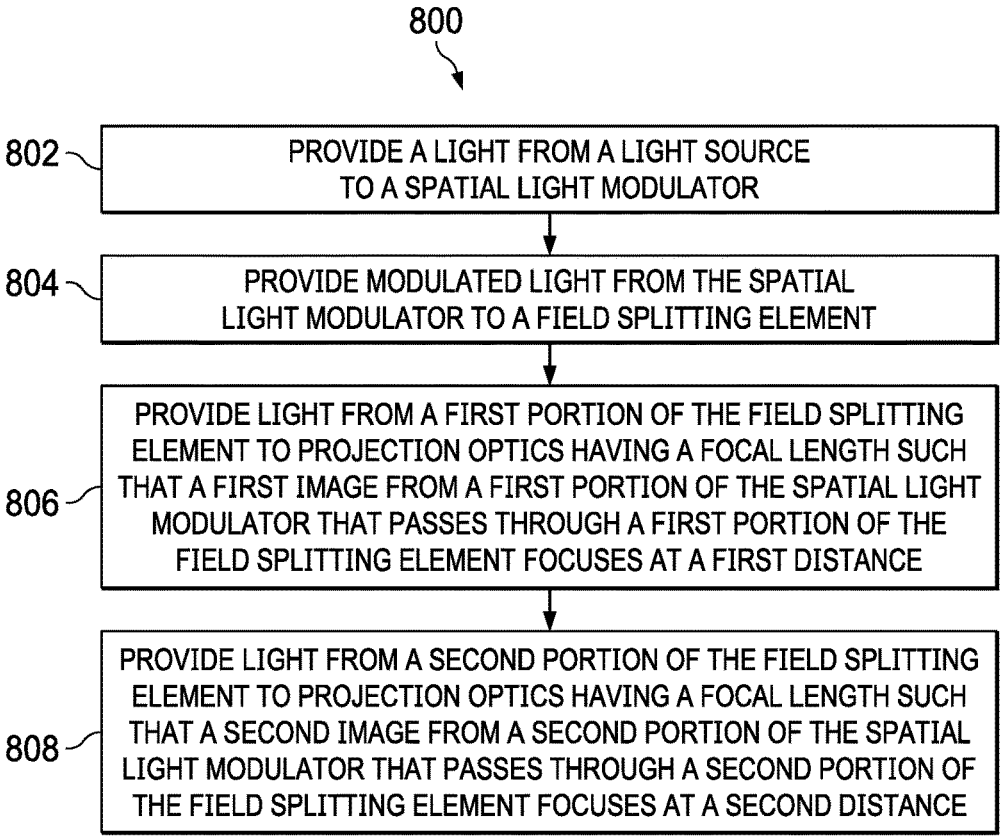
FIG. 8 is a flow chart of an example process.

FIG. 8 shows an example process 800 using the example projection systems described herein. Step 802 provides light from a light source such as light source 204 (FIG. 2) to a spatial light modulator such as spatial light modulator 208 (FIG. 2). Step 804 provides the light modulated by the spatial light modulator through a field splitting element such as FSE 202. Step 806 provides the light from a first portion of the field splitting element such as first portion 302 (FIG. 3) to projection optics such as projection optics 212 (FIG. 2) having a focal length such that a first image that passes through the first portion of the field splitting element is focused at a first distance. Step 808 provides the light from a second portion of the field splitting element such as second portion 304 (FIG. 3) to projection optics such as projection optics 212 (FIG. 2) having a focal length such that a second image that passes through the second portion of the field splitting element is focused at a second distance.

Modifications are possible in the described examples, and other examples are possible, within the scope of the claims.

What is claimed is:

1. A projection device comprising:

a light source;

a spatial light modulator arranged to receive light from the light source and provide modulated light;

projection optics arranged to receive and project the modulated light; and a field splitting element between the spatial light modulator and the projection optics, a first portion of the field splitting element being structured to pass at least a first portion of the modulated light to the projection optics for projection at a first focal length, and a second portion of the field splitting element being structured to pass at least a second portion of the modulated light to the projection optics for projection at a second focal length.

2. The projection device of claim 1, wherein the first focal length is longer than the second focal length.

3. The projection device of claim 1, wherein the field splitting element is an optically transparent material having a refractive index greater than one and the first portion having a first thickness and the second portion having a second thickness greater than the first thickness.

4. The projection device of claim 1, wherein the first portion has a first curvature and the second portion has a second curvature.

5. The projection device of claim 1, wherein the field splitting device further includes a coating to block infrared and ultraviolet radiation.

6. The projection device of claim 1, wherein the field splitting element is an optically transparent material having a refractive index greater than one and the first portion has a first thickness and the second portion has a variable thickness greater than the first thickness.

7. The projection device of claim 1, wherein the spatial light modulator is a digital micromirror device.

8. The projection device of claim 1, wherein the projection device is an automobile headlight.

9. A headlight projection device comprising:

a light source;

a spatial light modulator arranged to receive light from the light source and provide modulated light;

projection optics arranged to receive and project the modulated light; and a field splitting element between the spatial light modulator and the projection optics, a first portion of the field splitting element being structured to pass at least a first portion of the modulated light to the projection optics for projection at a first focal length, and a second portion of the field splitting element being structured to pass at least a second portion of the modulated light to the projection optics for projection at a second focal length.

10. The headlight projection device of claim 9, wherein the field splitting element is an optically transparent material having a refractive index greater than one and the first portion having a first thickness and the second portion having a second thickness greater than the first thickness.

11. The headlight projection device of claim 9, wherein the first portion has a first curvature and the second portion has a second curvature.

12. The headlight projection device of claim 9, wherein the field splitting device includes a coating to block infrared and ultraviolet radiation.

13. The headlight projection device of claim 9, wherein the field splitting element is an optically transparent material having a refractive index greater than one and the first portion has a first thickness and the second portion has a variable thickness greater than the first thickness.

14. The headlight projection device of claim 9, wherein the spatial light modulator is a digital micromirror device.

15. The headlight projection device of claim 9, wherein the headlight projection device is an automobile headlight.

16. A method comprising:

providing light from a light source to a spatial light modulator; and providing the light modulated by the spatial light modulator through a field splitting element having a first portion of the field splitting element to projection optics having a focal length such that a first image that passes through the first portion of the field splitting element is focused at a first distance, the field splitting element having a second portion of the field splitting element such that a second image that passes through the second portion of the field splitting element is focused at a second distance.

17. The method of claim 16, wherein the first distance is a greater distance than the second distance.

18. The method of claim 16, wherein the field splitting element is an optically transparent material having a refractive index greater than one and the first portion having a first thickness and the second portion having a second thickness greater than the first thickness.

19. The method of claim 16, wherein the first portion has a first curvature and the second portion has a second curvature.

20. The method of claim 16, wherein the field splitting element is an optically transparent material having a refractive index greater than one and the first portion has a first thickness and the second portion has a variable thickness greater than the first thickness.

* * * * *